US008160785B2

(12) United States Patent
Kahle et al.

(10) Patent No.: US 8,160,785 B2
(45) Date of Patent: Apr. 17, 2012

(54) VEHICLE AND VEHICLE ATTACHMENT

(75) Inventors: Kent Kahle, Dayton, OH (US); Michael Harvey Kidwell, Tipp City, OH (US); Vincent Lasher, West Milton, OH (US)

(73) Assignee: Trimble Navigation Limited, Sunnyvale, CA (US)

( * ) Notice: Subject to any disclaimer, the term of this patent is extended or adjusted under 35 U.S.C. 154(b) by 676 days.

(21) Appl. No.: 12/277,765

(22) Filed: Nov. 25, 2008

(65) Prior Publication Data

US 2010/0131157 A1 May 27, 2010

(51) Int. Cl.
*G06G 7/00* (2006.01)

(52) U.S. Cl. ..... 701/50

(58) Field of Classification Search ..... 37/231, 37/232, 348; 60/525, 526, 530, 531, 536; 172/2–11, 272, 273, 439; 180/14.1; 280/460.1, 280/481; 404/84.2, 101; 414/334, 699; 701/50
See application file for complete search history.

(56) References Cited

U.S. PATENT DOCUMENTS 3,791,753 A * 2/1974 Rymsa ..... 404/84.2
3,990,721 A * 11/1976 Hoffman ..... 280/481
5,171,124 A 12/1992 Foster
5,515,625 A 5/1996 Keigley
5,568,694 A * 10/1996 Capra et al. ..... 37/231
6,109,363 A * 8/2000 High ..... 172/820
6,223,828 B1 5/2001 Paulson et al.
6,360,459 B1 3/2002 Brookhart et al.
6,542,789 B2 4/2003 Ufheil
6,662,881 B2 * 12/2003 Domann ..... 172/272
6,837,319 B2 1/2005 Dvorak et al.
6,866,467 B2 3/2005 Dvorak et al.
6,978,612 B2 * 12/2005 Smith et al. ..... 60/525

* cited by examiner

*Primary Examiner* — Robert Pezzuto
(74) *Attorney, Agent, or Firm* — Dinsmore & Shohl LLP

(57) ABSTRACT

A vehicle and work attachment for the vehicle are disclosed in which the vehicle is of the type having a vehicle body, forward extending support arms, a motor-driven hydraulic fluid pump, hydraulic lines for carrying hydraulic fluid, a hydraulic fluid reservoir, and hydraulic cylinders for moving the arms with respect to the body. Controls may be provided for controlling the valves that control supply of hydraulic fluid to the hydraulic cylinders. These hydraulic valves may be mounted on the work attachment. Additionally, the work attachment may include hydraulic cylinders that are controlled by a control on the vehicle via valves mounted on the attachment. Processing circuitry on the attachment conditions the valve control signals. The attachment may also carry valves that control the supply of hydraulic fluid to hydraulic cylinders on the attachment for effecting movement of attachment elements. Quick connect hydraulic couplings facilitate changing attachments.

29 Claims, 2 Drawing Sheets

VEHICLE AND VEHICLE ATTACHMENT

CROSS-REFERENCE TO RELATED APPLICATION

Not applicable.

STATEMENT REGARDING FEDERALLY SPONSORED RESEARCH OR DEVELOPMENT

Not applicable.

BACKGROUND OF THE INVENTION

Skid steer loaders and multi-terrain loaders are used extensively in construction applications, in agricultural applications, and in other applications where power and versatility are needed. Skid steer loaders and multi-terrain loaders are essentially the same type of machine, with the exception of the ground engagement components. Typically, skid steer loaders move on wheels, while multi-terrain loaders are carried on tracks. However, both types of loaders offer relatively small size and high maneuverability, and can use a wide variety of attachment work tools, making them extremely flexible in application. Skid steer loaders and multi-terrain loaders may be used to dig, to level, to cut, to carry, to load, and to perform any number of other tasks. For each such task, the loader carries a specially designed attachment on the loader arms that extend forward from the loader body.

Skid steer loaders and multi-terrain loaders typically are hydraulically powered. An hydraulic pump, driven by a diesel engine, supplies hydraulic fluid under pressure to various vehicle components. A loader typically has a pair of hydraulic motors that drive the vehicle wheels or tracks. The loader is turned by driving the wheels or tracks at differing speeds. The loader arms that extend forward from the vehicle and to which a bucket, grapple, blade or other attachment is mounted, are also moved by means of hydraulic cylinders that are appropriately configured and controlled by the loader operator. To accomplish this control, the vehicle operator typically uses joy stick controls, or similar controls, in the operator cab.

One significant advantage offered by skid steer loaders and multi-terrain loaders is their ability to carry and operate dozens of different attachments, changing the function of the machine as rapidly as the attachments can be changed. These numerous attachments include augers, bale handlers, brooms, buckets, cold planers, concrete pulverizers, cutters, dozer blades, fertilizer spreaders, fork lift forks, grapples, hitches, landscape rakes, mowers, mulchers, plate compactors, pole claws, pot movers, rock and tree handlers, rock saws, rollers, rotary brooms, shears, snow blowers, splitters, stump grinders, swale blades, tillers, tree spades, trenchers, and winches, among others. Each of these attachments or work tools is unique. Some of the attachments are mounted on the ends of the forward extending loader arms and are simply raised, lowered and reoriented by hydraulic cylinders on the loader that control the position of the arms and the orientation of the attachment coupler at the ends of the arms. Many of the attachments, however, have additional moving elements on the attachment that are powered by one or more hydraulic cylinders carried on the attachment. For example, a grapple attachment may have jaw-like teeth that are moved in relation to each other to grasp an object. One or more hydraulic cylinders are carried on the attachment to effect this movement.

Controlling hydraulic cylinders that are carried on attachments has been problematic. Typically, hydraulic valves on the loader are controlled by an operator to control the flow of hydraulic fluid to the cylinders on an attachment. Because the designs of the various attachments are so diverse, the movement rates of the cylinders on the attachments that is needed or preferred for operation of the attachments may vary significantly. Consequently, the valves must be actuated differently when an operator is controlling various attachments. Movement of an attachment element might, for example, be slower or faster than desired. Similarly, controlling the hydraulic cylinders on the vehicle that control the position of the arms and the orientation of the coupler at the ends of the arms that engages the coupler is also difficult in that the speed of movement and the fluid flow needed to move these cylinders varies among the various attachments. As a consequence, rapid changing of attachments has been made more difficult due to the need to adjust the hydraulics for changes in operation.

SUMMARY OF THE INVENTION

In one embodiment, a work attachment is provided for a vehicle. The vehicle has a vehicle body, forward extending support arms, a motor-driven hydraulic fluid pump, hydraulic lines for carrying hydraulic fluid, a hydraulic fluid reservoir, hydraulic cylinders for moving the arms with respect to the body, valves for controlling the supply of hydraulic fluid to the hydraulic cylinders, and controls for controlling the valves. The vehicle further includes a control for providing one or more electrical control signals on a vehicle attachment control line for controlling an attachment. The work attachment is mounted on the forward extending support arms. The work attachment has relatively movable attachment elements and one or more attachment hydraulic cylinders for effecting movement of the attachment elements. Hydraulic fluid lines having quick connect couplings for connection to the hydraulic lines of the vehicle are included on the attachment. An attachment electrical control line for connection to the vehicle attachment control line is included on the attachment. A processing circuit, on the attachment, is responsive to the one or more electrical control signals on the attachment electrical control line for providing one or more valve control signals. Finally, electrically actuated hydraulic valves on the attachment are connected to the hydraulic fluid lines and are responsive to the one or more valve control signals, for controlling the application of hydraulic fluid to the one or more attachment hydraulic cylinders in response to the one or more valve control signals.

The work attachment can be any of a number of different hydraulically powered devices. For example, the work attachment can be an auger, a bale handler, a broom, a bucket, a cold planer, a concrete pulverizer, a cutter, a dozer blade, a fertilizer spreader, fork lift forks, a grapple, a hitch, a landscape rake, a mower, a mulcher, a plate compactor, a pole claw, a pot mover, a rock and tree handler, a rock saw, a roller, a rotary broom, a shear, a snow blower, a splitter, a stump grinder, a swale blade, a tiller, a tree spade, a trencher, or a winch.

The processing circuit is responsive to the one or more electrical control signals on the attachment electrical control line. The processing circuit may comprise an amplifier circuit for providing one or more valve control signals of appropriate amplitude to control the operation of the electrically actuated hydraulic valves and the attachment. The valve control signals are preferably specifically matched to the performance characteristics of the valve they control by the amplifier.

In another embodiment, the vehicle has a vehicle body, forward extending support arms, a motor-driven hydraulic fluid pump, hydraulic lines for carrying hydraulic fluid, a hydraulic fluid reservoir, hydraulic cylinders for moving the arms with respect to the body, and a control for providing one or more electrical control signals on a hydraulic cylinder control line for controlling the hydraulic cylinders. A work attachment is mounted on the forward extending support arms. The work attachment includes hydraulic fluid lines having quick connect couplings for connection to the hydraulic lines of the vehicle, an attachment electrical control line for connection to the hydraulic cylinder control line, a processing circuit, responsive to the one or more electrical control signals on the attachment electrical control line, for providing one or more valve control signals, and electrically actuated hydraulic valves, connected to the hydraulic fluid lines on the work attachment. The valves are responsive to the one or more valve control signals, for controlling the application of hydraulic fluid to the hydraulic cylinders on the vehicle body in response to the one or more valve control signals.

A vehicle may comprise a vehicle body, forward extending support arms, a motor-driven hydraulic fluid pump, hydraulic lines for carrying hydraulic fluid, a hydraulic fluid reservoir, hydraulic cylinders for moving the arms with respect to the body, valves for controlling the supply of hydraulic fluid to the hydraulic cylinders, controls for controlling the valves, a control for providing one or more electrical control signals on a vehicle attachment control line for controlling an attachment, a processing circuit, responsive to the one or more electrical control signals on the attachment electrical control line for providing one or more valve control signals, and a work attachment, mounted on the forward extending support arms. A vehicle attachment may have relatively movable attachment elements and one or more attachment hydraulic cylinders for effecting movement of the attachment elements, hydraulic fluid lines having quick connect couplings for connection to the hydraulic lines of the vehicle, and electrically actuated hydraulic valves, connected to the hydraulic fluid lines and responsive to the one or more valve control signals, for controlling the application of hydraulic fluid to the one or more attachment hydraulic cylinders in response to the one or more valve control signals. The processing circuit may comprise an amplifier circuit for providing one or more valve control signals of appropriate amplitude to control the operation of the electrically actuated hydraulic valves and the attachment.

It is an object of the present invention to provide an improved vehicle and work attachment in which hydraulic valves are carried on the attachment, rather than on the vehicle, thereby facilitating changing attachments on the vehicle.

DETAILED DESCRIPTION OF THE PREFERRED EMBODIMENT

Figure 1:
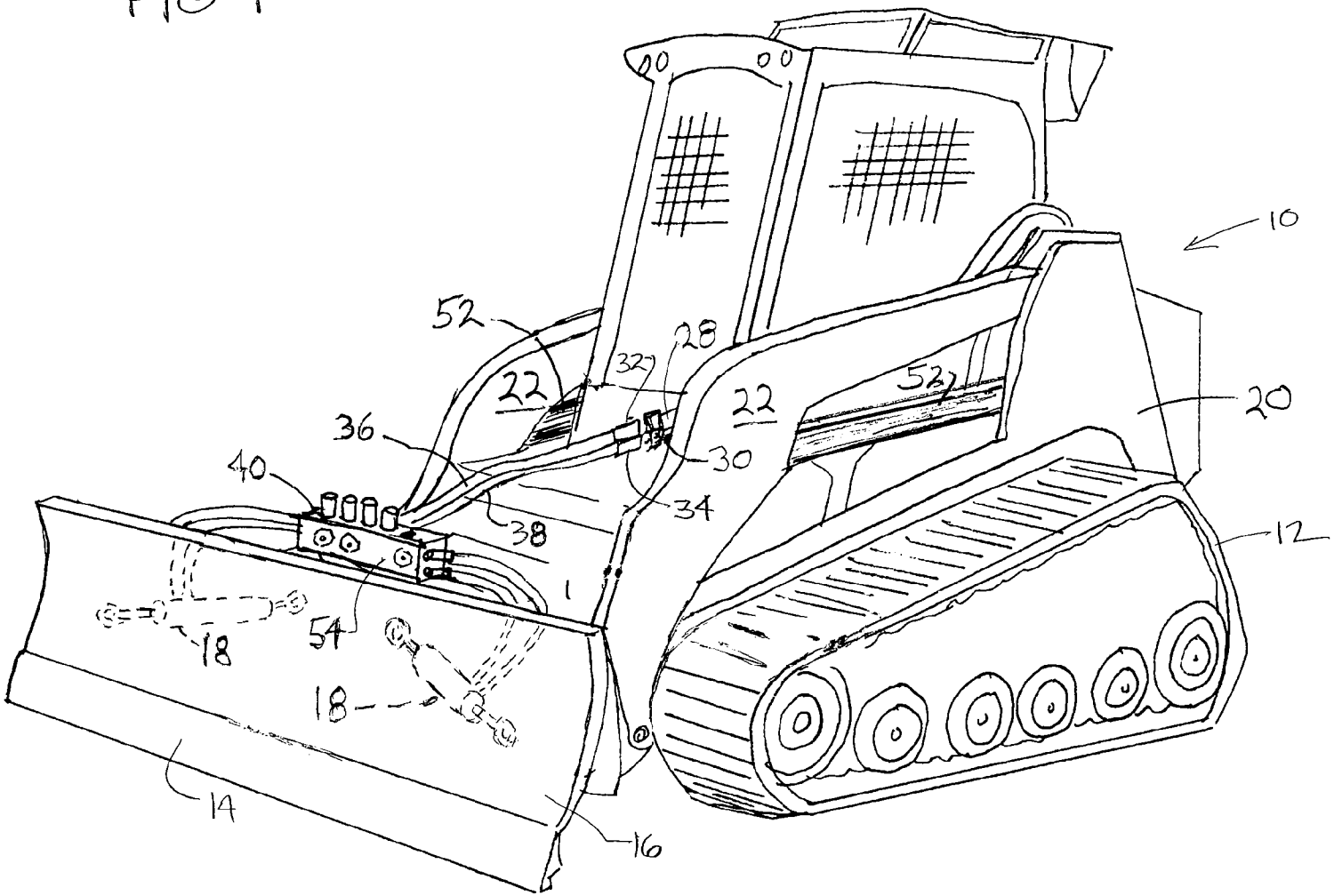
FIG. 1 is a perspective view of a multi-terrain loader and a blade attachment.
Figure 2:
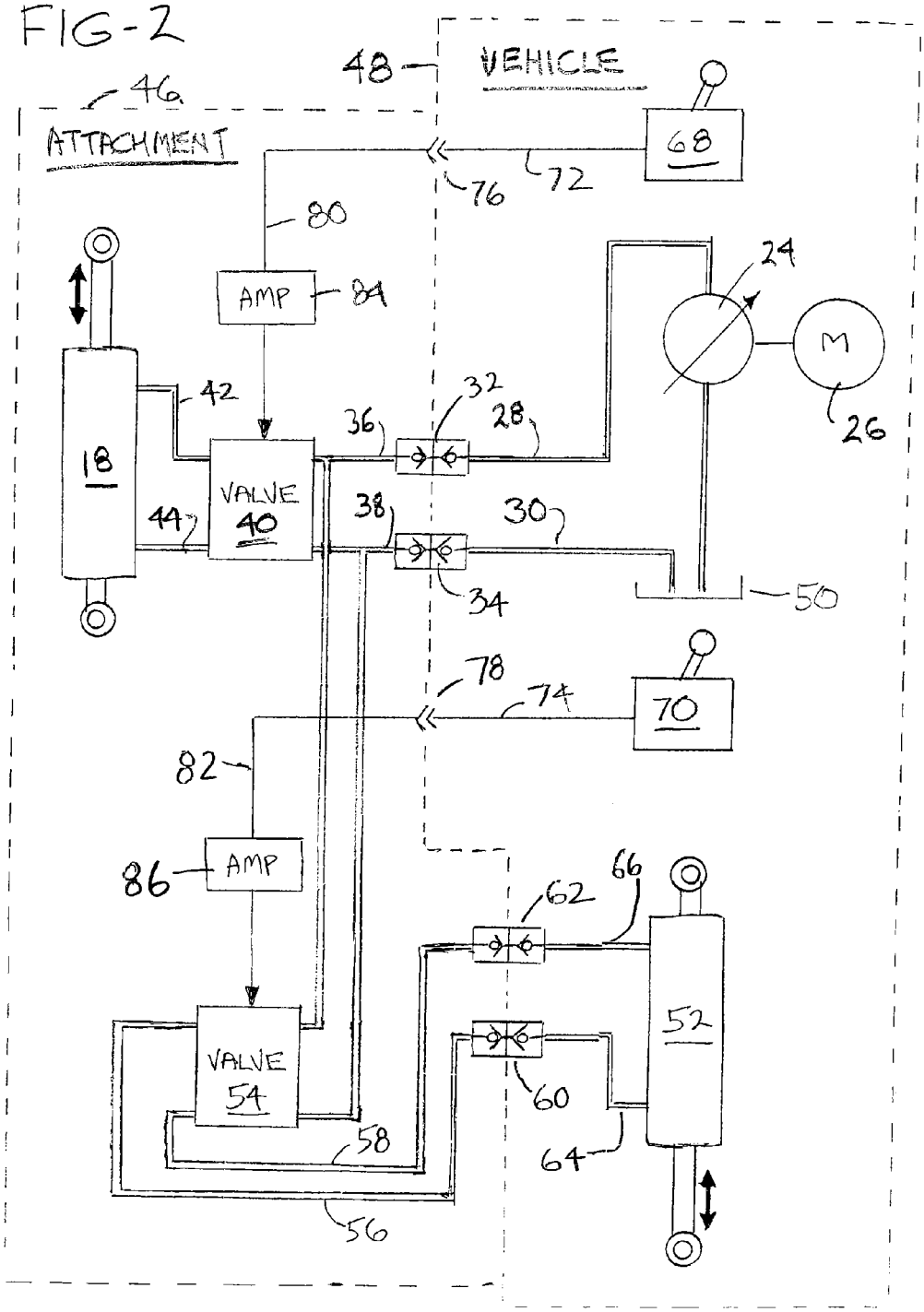
FIG. 2 is a schematic diagram showing the hydraulic and electrical controls for the loader attachment.

FIGS. 1 and 2 illustrate one embodiment of a loader and an attachment contemplated by applicants. FIG. 1 shows a multi-terrain loader 10 of the type having a pair of continuous tracks 12, only one of which may be seen in FIG. 1. The tracks 12 are typically separately driven by hydraulic motors so that the loader 10 can be precisely controlled, being capable of turning quickly or even rotating in place. Although a multi-terrain loader 10 is shown in the drawing and described, below, it should be appreciated that the various embodiments include skid steer loaders and a wide variety of other vehicles that can use hydraulically driven or controlled, interchangeable, attachments. Similarly, the attachment 14 is illustrated as a blade 16, although any of a large number of interchangeable work attachments may be used with these embodiments. For example, the attachment 14 may be an auger, a bale handler, a broom, a bucket, a cold planer, a concrete pulverizer, a cutter, a dozer blade, a fertilizer spreader, a fork lift forks, a grapple, a hitch, a landscape rake, a mower, a mulcher, a plate compactor, a pole claw, a pot mover, a rock and tree handler, a rock saw, a roller, a rotary broom, a shear, a snow blower, a splitter, a stump grinder, a swale blade, a tiller, a tree spade, a trencher, or a winch. Some of these attachments include hydraulic cylinders, such as cylinders 18 on blade 16, to effect movement of various attachment elements. Others of the attachments have elements that all remain in fixed relationship during use and therefore do not require hydraulic cylinders.

The loader 10 has a vehicle body 20 supported by the tracks 12, and further includes forward extending support arms 22. As seen in FIG. 2, a motor-driven hydraulic pump 24, driven by motor 26, supplies hydraulic fluid via lines 28 and 30 via quick coupling devices 32 and 34, to lines 36 and 38, and via hydraulic valve 40, and hydraulic lines 42 and 44, to a pair of hydraulic cylinders 18 on work attachment 14. For purposes of simplicity of illustration, only one of the cylinders 18 and its associated valves and controls, is shown in FIG. 2. It will be appreciated that the interchangeable attachments that can be used with the loader 10 have variously connected hydraulic cylinders, and that some may only have one such cylinder, mounted on the attachment. For purposes of illustrating the position of the various components in FIG. 2, the attachment mounted components are shown within dashed lines 46, and the vehicle mounted components are shown within dashed lines 48.

The loader 10 has a hydraulic fluid reservoir 50, and hydraulic cylinders 52 for moving the arms 22 with respect to the body 20. Cylinders 52 typically are operated together so that they can be connected in parallel. Other hydraulic cylinders, not shown, are typically provided to control the orientation of the attachment coupler at the ends of the arms 22. Only one such cylinder is shown in FIG. 2 as cylinder 52 for simplicity of illustration, although it will be appreciated that this represents the cylinders positioning the arms and the coupler. As shown in FIG. 2, a valve 54 provides hydraulic fluid from lines 36 and 38 back to the vehicle 10 via lines 56 and 58, hydraulic quick connectors 60 and 62, and lines 64 and 66. Controlling the operation of valve 40 is a manual control 68 which may be a joy stick type of manually actuated controller. Similarly, controlling the operation of valve 54 is a manual control 70 which may also be a joy stick type of manually actuated controller. Electrical control signals on vehicle attachment control line 72 and 74 are applied to valves 40 and 54 via connectors 76 and 78, attachment electrical control line 80 and 82 and processing circuits 84 and 86, respectively. Circuits 84 and 86 provide appropriately conditioned valve control signals. Although shown as manually controlled, it will be appreciated that the electrical control signals on lines 72 and 74 may also be generated by automated control systems of various known types. Further, although shown as mounted on the attachment 46, circuits 84 and 86 may alternatively be mounted on the vehicle 48 in lines 72 and 74, respectively, so that the circuits 84 and 86 do not change from one attachment 46 to the next. Yet, as a further alternative, one of circuits 84 and 86 may be mounted on the vehicle 48 and the other of circuits 84 and 86 may be mounted on the attachment 46.

It will be apparent from a review of FIGS. 1 and 2 that a vehicle and work attachment configured in this fashion is highly advantageous. The electrical and hydraulic connections between the vehicle and the attachment may be connected and disconnected quickly by means of electrical connectors 76 and 78 and hydraulic quick connectors 32, 34, 60, and 62. Further, the hydraulic valves 40 and 54 are mounted on the attachment so that they, and possibly one or both of the circuits 84 and 86, are changed with the attachment. As a result, the hydraulic valves and electrical circuits can be specifically designed and calibrated to facilitate operation of the individual attachment. It should also be appreciated that, if desired, an embodiment may be utilized in which only one of the valves 40 and 54 is carried on the attachment and the other valve is carried on the vehicle. Further, other embodiments are contemplated in which there are no hydraulic cylinders needed for the attachment, but that the attachment nevertheless carries the valve 54 for control of the hydraulic cylinders 52 or other hydraulic cylinders on the vehicle.

Although the presently preferred embodiments of this invention have been described, it will be understood that within the purview of the invention various changes may be made within the scope of the following claims.

What is claimed is:

1. A machine, comprising:

a vehicle having a vehicle body, forward extending support arms, a motor-driven hydraulic fluid pump, hydraulic lines for carrying hydraulic fluid, a hydraulic fluid reservoir, hydraulic cylinders for moving said arms with respect to said body;

valves for controlling the supply of hydraulic fluid to said hydraulic cylinders;

controls for controlling said valves;

a control for providing one or more electrical control signals on a vehicle attachment control line for controlling an attachment; and a work attachment, mounted on said forward extending support arms, having relatively movable attachment elements and one or more attachment hydraulic cylinders for effecting movement of said attachment elements, hydraulic fluid lines having quick connect couplings for connection to the hydraulic lines of the vehicle;

an attachment electrical control line for connection to said vehicle attachment control line;

a processing circuit, responsive to said one or more electrical control signals on said attachment electrical control line for providing one or more valve control signals, and electrically actuated hydraulic valves, connected to said hydraulic fluid lines and responsive to said one or more valve control signals, for controlling the application of hydraulic fluid to said one or more attachment hydraulic cylinders in response to said one or more valve control signals.

2. A machine according to claim 1, in which said work attachment is selected from the group consisting of: auger, bale handler, broom, bucket, cold planer, concrete pulverizer, cutter, dozer blade, fertilizer spreader, fork lift forks, grapple, hitch, landscape rake, mower, mulcher, plate compactor, pole claw, pot mover, rock and tree handler, rock saw, roller, rotary broom, shear, snow blower, splitter, stump grinder, swale blade, tiller, tree spade, trencher, and winch.

3. A machine according to claim 1, in which said a processing circuit, responsive to said one or more electrical control signals on said attachment electrical control line, comprises an amplifier circuit for providing one or more valve control signals of appropriate amplitude to control the operation of said electrically actuated hydraulic valves and said attachment.

4. A work attachment for a vehicle of the type having a vehicle body, forward extending support arms, a motor-driven hydraulic fluid pump, hydraulic lines for carrying hydraulic fluid, a hydraulic fluid reservoir, hydraulic cylinders for moving said arms with respect to said body, and a control for providing one or more electrical control signals on a vehicle attachment control line for controlling the attachment, comprising:

relatively movable attachment elements and one or more attachment hydraulic cylinders for effecting movement of said attachment elements;

hydraulic fluid lines having quick connect couplings for connection to the hydraulic lines of the vehicle;

an attachment electrical control line for connection to said vehicle attachment control line;

a processing circuit, responsive to said one or more electrical control signals on said attachment electrical control line for providing one or more valve control signals; and electrically actuated hydraulic valves, connected to said hydraulic fluid lines and responsive to said one or more valve control signals, for controlling the application of hydraulic fluid to said one or more attachment hydraulic cylinders in response to said one or more valve control signals.

5. A work attachment for a vehicle according to claim 4, in which said work attachment is selected from the group consisting of: auger, bale handler, broom, bucket, cold planer, concrete pulverizer, cutter, dozer blade, fertilizer spreader, fork lift forks, grapple, hitch, landscape rake, mower, mulcher, plate compactor, pole claw, pot mover, rock and tree handler, rock saw, roller, rotary broom, shear, snow blower, splitter, stump grinder, swale blade, tiller, tree spade, trencher, and winch.

6. A work attachment for a vehicle according to claim 4, in which said processing circuit, responsive to said one or more electrical control signals on said attachment electrical control line, comprises an amplifier circuit for providing one or more valve control signals of appropriate amplitude to control the operation of said electrically actuated hydraulic valves and said attachment.

7. A work attachment for a vehicle according to claim 5, in which said valve control signals are specifically matched to the performance characteristics of the valve they control.

8. A work attachment for a vehicle according to claim 7 in which said amplifier circuit matches the valve control signals to the operating characteristics of the valve or valves being controlled.

9. A work attachment for a vehicle, said vehicle having a motor-driven hydraulic fluid pump, hydraulic lines for carrying hydraulic fluid, and a control for providing one or more electrical control signals on a vehicle attachment control line for controlling an attachment, comprising:

relatively movable attachment elements and one or more attachment hydraulic cylinders for effecting movement of said attachment elements, hydraulic fluid lines having quick connect couplings for connection to the hydraulic lines of the vehicle;

an attachment electrical control line for connection to said vehicle attachment control line;

a processing circuit, responsive to said one or more electrical control signals on said attachment electrical control line for providing one or more valve control signals, and one or more electrically actuated hydraulic valves, connected to said hydraulic fluid lines and responsive to said one or more valve control signals, for controlling the application of hydraulic fluid to said one or more attachment hydraulic cylinders in response to said one or more valve control signals.

10. A work attachment according to claim 9, selected from the group consisting of: auger, bale handler, broom, bucket, cold planer, concrete pulverizer, cutter, dozer blade, fertilizer spreader, fork lift forks, grapple, hitch, landscape rake, mower, mulcher, plate compactor, pole claw, pot mover, rock and tree handler, rock saw, roller, rotary broom, shear, snow blower, splitter, stump grinder, swale blade, tiller, tree spade, trencher, and winch.

11. A work attachment according to claim 9, in which said a processing circuit, responsive to said one or more electrical control signals on said attachment electrical control line, comprises an amplifier circuit for providing one or more valve control signals of appropriate amplitude to control the operation of said electrically actuated hydraulic valves and said attachment.

12. A work attachment according to claim 9, in which said valve control signals are specifically matched to the performance characteristics of the valve they control.

13. A work attachment according to claim 12 in which said amplifier circuit matches the valve control signals to the operating characteristics of the valve or valves being controlled.

14. A machine comprising:

a vehicle having a vehicle body, forward extending support arms, a motor-driven hydraulic fluid pump, hydraulic lines for carrying hydraulic fluid, a hydraulic fluid reservoir, hydraulic cylinders for moving said arms with respect to said body, and a control for providing one or more electrical control signals on a hydraulic cylinder control line for controlling said hydraulic cylinders, and a work attachment, mounted on said forward extending support arms, having hydraulic fluid lines having quick connect couplings for connection to the hydraulic lines of the vehicle;

an attachment electrical control line for connection to said hydraulic cylinder control line;

a processing circuit, responsive to said one or more electrical control signals on said attachment electrical control line, for providing one or more valve control signals, and electrically actuated hydraulic valves, connected to said hydraulic fluid lines on said work attachment, and responsive to said one or more valve control signals, for controlling the application of hydraulic fluid to said hydraulic cylinders on said vehicle body in response to said one or more valve control signals.

15. A machine according to claim 14, in which said work attachment is selected from the group consisting of: auger, bale handler, broom, bucket, cold planer, concrete pulverizer, cutter, dozer blade, fertilizer spreader, fork lift forks, grapple, hitch, landscape rake, mower, mulcher, plate compactor, pole claw, pot mover, rock and tree handler, rock saw, roller, rotary broom, shear, snow blower, splitter, stump grinder, swale blade, tiller, tree spade, trencher, and winch.

16. A machine according to claim according to claim 14, in which said a processing circuit, responsive to said one or more electrical control signals on said attachment electrical control line, comprises an amplifier circuit for providing one or more valve control signals of appropriate amplitude to control the operation of said hydraulic valves and said hydraulic cylinders on said vehicle body.

17. A work attachment for a vehicle of the type having a vehicle body, forward extending support arms, a motor-driven hydraulic fluid pump, hydraulic lines for carrying hydraulic fluid, a hydraulic fluid reservoir, hydraulic cylinders for moving said arms with respect to said body, and a control for providing one or more electrical control signals on a hydraulic cylinder control line for controlling said hydraulic cylinders, comprising:

hydraulic fluid lines having quick connect couplings for connection to the hydraulic lines of the vehicle;

an attachment electrical control line for connection to said hydraulic cylinder control line;

a processing circuit, responsive to said one or more electrical control signals on said attachment electrical control line, for providing one or more valve control signals, and electrically actuated hydraulic valves on said work attachment, connected to said hydraulic fluid lines and responsive to said one or more valve control signals, for controlling the application of hydraulic fluid to said hydraulic cylinders on said vehicle body in response to said one or more valve control signals.

18. A work attachment for a vehicle according to claim 17, in which said work attachment is selected from the group consisting of: auger, bale handler, broom, bucket, cold planer, concrete pulverizer, cutter, dozer blade, fertilizer spreader, fork lift forks, grapple, hitch, landscape rake, mower, mulcher, plate compactor, pole claw, pot mover, rock and tree handler, rock saw, roller, rotary broom, shear, snow blower, splitter, stump grinder, swale blade, tiller, tree spade, trencher, and winch.

19. A work attachment for a vehicle according to claim 17, in which said processing circuit, responsive to said one or more electrical control signals on said attachment electrical control line, comprises an amplifier circuit for providing one or more valve control signals of appropriate amplitude to control the operation of said hydraulic valves and said hydraulic cylinders on said vehicle body.

20. A work attachment for a vehicle according to claim 19, in which said valve control signals are specifically matched to the performance characteristics of the valve they control.

21. A work attachment for a vehicle according to claim 20 in which said amplifier circuit matches the valve control signals to the operating characteristics of the valve or valves being controlled.

22. A machine, comprising:

a vehicle having a vehicle body, forward extending support arms, a motor-driven hydraulic fluid pump, hydraulic lines for carrying hydraulic fluid, a hydraulic fluid reservoir, hydraulic cylinders for moving said arms with respect to said body;

valves for controlling the supply of hydraulic fluid to said hydraulic cylinders;

controls for controlling said valves;

a control for providing one or more electrical control signals on a vehicle attachment control line for controlling an attachment;

a processing circuit, responsive to said one or more electrical control signals on said attachment electrical control line for providing one or more valve control signals; and a work attachment, mounted on said forward extending support arms, having relatively movable attachment elements and one or more attachment hydraulic cylinders for effecting movement of said attachment elements, hydraulic fluid lines having quick connect couplings for connection to the hydraulic lines of the vehicle; and electrically actuated hydraulic valves, connected to said hydraulic fluid lines and responsive to said one or more valve control signals, for controlling the application of hydraulic fluid to said one or more attachment hydraulic cylinders in response to said one or more valve control signals.

23. A machine according to claim 22, in which said work attachment is selected from the group consisting of: auger, bale handler, broom, bucket, cold planer, concrete pulverizer, cutter, dozer blade, fertilizer spreader, fork lift forks, grapple, hitch, landscape rake, mower, mulcher, plate compactor, pole claw, pot mover, rock and tree handler, rock saw, roller, rotary broom, shear, snow blower, splitter, stump grinder, swale blade, tiller, tree spade, trencher, and winch.

24. A machine according to claim 22, in which said a processing circuit, responsive to said one or more electrical control signals on said attachment electrical control line, comprises an amplifier circuit for providing one or more valve control signals of appropriate amplitude to control the operation of said electrically actuated hydraulic valves and said attachment.

25. A work attachment for a vehicle of the type having a vehicle body, forward extending support arms, a motor-driven hydraulic fluid pump, hydraulic lines for carrying hydraulic fluid, a hydraulic fluid reservoir, hydraulic cylinders for moving said arms with respect to said body, a control for providing one or more electrical control signals on a vehicle attachment control line for controlling the attachment, and a processing circuit, responsive to said one or more electrical control signals on said attachment electrical control line for providing one or more valve control signal, comprising:

relatively movable attachment elements and one or more attachment hydraulic cylinders for effecting movement of said attachment elements;

hydraulic fluid lines having quick connect couplings for connection to the hydraulic lines of the vehicle; and electrically actuated hydraulic valves, connected to said hydraulic fluid lines and responsive to said one or more valve control signals, for controlling the application of hydraulic fluid to said one or more attachment hydraulic cylinders in response to said one or more valve control signals.

26. A work attachment for a vehicle according to claim 25, in which said work attachment is selected from the group consisting of: auger, bale handler, broom, bucket, cold planer, concrete pulverizer, cutter, dozer blade, fertilizer spreader, fork lift forks, grapple, hitch, landscape rake, mower, mulcher, plate compactor, pole claw, pot mover, rock and tree handler, rock saw, roller, rotary broom, shear, snow blower, splitter, stump grinder, swale blade, tiller, tree spade, trencher, and winch.

27. A work attachment for a vehicle according to claim 25, in which said processing circuit, responsive to said one or more electrical control signals on said attachment electrical control line, comprises an amplifier circuit for providing one or more valve control signals of appropriate amplitude to control the operation of said electrically actuated hydraulic valves and said attachment.

28. A work attachment for a vehicle according to claim 26, in which said valve control signals are specifically matched to the performance characteristics of the valve they control.

29. A work attachment for a vehicle according to claim 28 in which said amplifier circuit matches the valve control signals to the operating characteristics of the valve or valves being controlled.

* * * * *